US012037908B1

(12) United States Patent
Pei et al.

(10) Patent No.: US 12,037,908 B1
(45) Date of Patent: Jul. 16, 2024

(54) METHOD FOR MONITORING AND ANALYZING LARGE TUNNEL MACHINES BASED ON AUTOMATIC COLLECTION OF BIG DATA

(71) Applicants: CHINA TIESIJU CIVIL ENGINEERING GROUP CO., LTD., Hefei (CN); ANHUI DIGITAL INTELLIGENT CONSTRUCTION RESEARCH INSTITUTE CO., LTD, Hefei (CN)

(72) Inventors: Xiaofang Pei, Hefei (CN); Heng Wang, Changchun (CN); Xiang Shen, Hefei (CN); Liang Li, Lu'an (CN); Lina Xiao, Hefei (CN); Yuefeng Chu, Zhoukou (CN); Lulu Tian, Beijing (CN); Ren Huang, Bengbu (CN); Shouqiang Yin, Hefei (CN); Hao Liang, Hefei (CN); Lidong Yang, Hefei (CN); Di Liu, Changchun (CN); Jingyi Wu, Nanjing (CN); Xiaoxu Yang, Dali (CN); Kuo Zhang, Hefei (CN); Kaixuan Li, Suzhou (CN)

(73) Assignees: CHINA TIESIJU CIVIL ENGINEERING GROUP CO., LTD., Hefei (CN); ANHUI DIGITAL INTELLIGENT CONSTRUCTION RESEARCH INSTITUTE CO., LTD, Hefei (CN)

( * ) Notice: Subject to any disclaimer, the term of this patent is extended or adjusted under 35 U.S.C. 154(b) by 0 days.

(21) Appl. No.: 18/538,253

(22) Filed: Dec. 13, 2023

Related U.S. Application Data

(63) Continuation of application No. PCT/CN2023/124638, filed on Oct. 16, 2023.

(30) Foreign Application Priority Data

May 17, 2023 (CN) ..... 202310552795.6

(51) Int. Cl.
*E21D 9/00* (2006.01)
*E21D 9/10* (2006.01)
*E21F 17/18* (2006.01)

(52) U.S. Cl.
CPC ..... *E21D 9/003* (2013.01); *E21D 9/1006* (2013.01); *E21D 9/108* (2013.01); *E21F 17/18* (2013.01)

(58) Field of Classification Search
CPC ..... E21D 9/003; E21D 9/1006; E21D 9/108; E21F 17/18
See application file for complete search history.

(56) References Cited

U.S. PATENT DOCUMENTS 11,668,192 B2 * 6/2023 Weiser ..... E21D 9/112 299/1.8
2009/0297273 A1 * 12/2009 Lindbergh ..... G01P 3/22 702/9

(Continued)

FOREIGN PATENT DOCUMENTS

CN 111005728 A 4/2020
CN 114352290 A 4/2022

(Continued)

OTHER PUBLICATIONS

First Office Action issued in counterpart Chinese Patent Application No. 202310552795.6, dated Jun. 29, 2023.

(Continued)

*Primary Examiner* — Janine M Kreck
(74) *Attorney, Agent, or Firm* — Westbridge IP LLC

(57) ABSTRACT

A method for monitoring and analyzing large tunnel machines based on automatic collection of big data includes (Continued)

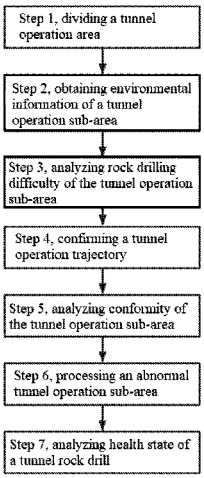

the following steps: dividing a tunnel operation area, obtaining environmental information of a tunnel operation sub-area, analyzing rock drilling difficulty of the tunnel operation sub-area, confirming a tunnel operation trajectory, analyzing conformity of the tunnel operation sub-area, processing an abnormal tunnel operation sub-area, and analyzing health state of a tunnel rock drill. According to the present disclosure, a rock drilling difficulty coefficient of each tunnel operation sub-area is used to analyze a corresponding steel rotating speed, and then the tunnel operation trajectory is confirmed. After the tunnel operation is completed, the operation conformity of each tunnel operation sub-area is analyzed, and each abnormal tunnel operation sub-area is screened out and processed accordingly.

10 Claims, 1 Drawing Sheet

(56) References Cited

U.S. PATENT DOCUMENTS

| | | | |
|---|---|---|---|
| 2022/0112806 | A1 | 4/2022 | Luo et al. |
| 2023/0051333 | A1 | 2/2023 | Wang et al. |

FOREIGN PATENT DOCUMENTS

| | | | |
|---|---|---|---|
| CN | 114972384 | A | 8/2022 |
| CN | 115288798 | A | 11/2022 |
| CN | 115788478 | A | 3/2023 |
| EP | 3385500 | A1 | 10/2018 |
| WO | 2021205428 | A1 | 10/2021 |

OTHER PUBLICATIONS

Qu et al., Advanced Geological Prediction Technology Based on Tunnel Face Borehole Drilling, Journal of Highway and Transportation Research and Development, vol. 37, No. 7, pp. 97-110, dated Jul. 31, 2020.

Zhang, Research on Construction Technology of Rail Transit Tunnels with Ultra Small Clearance Undercrossing Operating Railways and Operating Section Tunnels, Proceedings of the 2019 (3rd) Shanghai International Urban Rail Transit Construction Summit Forum, Suppl. 2, 2019, pp. 101-105, dated Nov. 11, 2019.

* cited by examiner

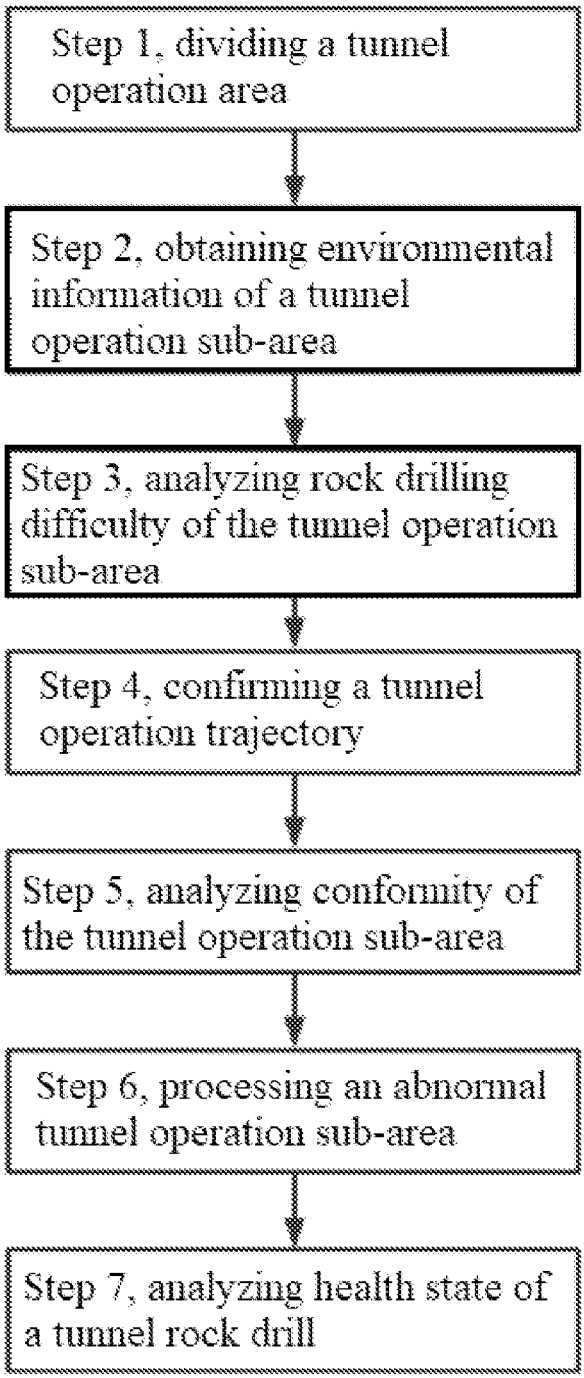
Step 1, dividing a tunnel operation area
Step 2, obtaining environmental information of a tunnel operation sub-area
Step 3, analyzing rock drilling difficulty of the tunnel operation sub-area
Step 4, confirming a tunnel operation trajectory
Step 5, analyzing conformity of the tunnel operation sub-area
Step 6, processing an abnormal tunnel operation sub-area
Step 7, analyzing health state of a tunnel rock drill

METHOD FOR MONITORING AND ANALYZING LARGE TUNNEL MACHINES BASED ON AUTOMATIC COLLECTION OF BIG DATA

CROSS-REFERENCE TO RELATED APPLICATION

This application is a continuation of International Application No. PCT/CN2023/124638, filed on Oct. 16, 2023, which claims priority to Chinese Patent Application No. 202310552795.6, filed on May 17, 2023. All of the aforementioned applications are incorporated herein by reference in their entireties.

TECHNICAL FIELD

The present disclosure belongs to the technical field of monitoring and analysis of large tunnel machines, and relates to a method for monitoring and analyzing large tunnel machines based on automatic collection of big data.

BACKGROUND

Large tunnel machines generally refers to the mechanical equipment used in underground tunnel excavation, such as drills, bulldozers, rock drills, etc. Generally, such mechanical equipment not only needs to go through long-term operation and continuous hard work during tunnel excavation, but also is easily affected by environmental degradation. Therefore, it is essential to monitor and analyze large tunnel machines.

In the prior art, the tunnel rock drill are monitored and analyzed, so as to monitor various parameter information of the tunnel rock drill by various sensors installed on the tunnel rock drill, such as temperature, pressure, vibration and the like, obtain the working state of the tunnel rock drill in real time, and detect whether the tunnel rock drill has a fault or an abnormality. However, there are still a large number of limitations in the prior art for monitoring and analyzing the tunnel rock drill. The specific limitations are as follows. The monitoring and analysis of the operation of the tunnel rock drill in the prior art lack detailed and accurate analysis of the operation trajectory of the tunnel rock drill. In the actual rock drilling process of the tunnel, when only controlling the rotating speed of the steel of the rock drill only by the experience of the staff, it is easy to result in the problems that the rotating speed of the steel may fluctuate variously, which does not meet the actual geological conditions of the tunnel, thus leading to the damage of the steel, the increase of energy consumption of the rock drill, the slowdown of the tunnel drilling speed, and greatly reducing the service life of the tunnel rock drill.

At present, there is no relevant technology to monitor the completion of tunnel excavation by using a tunnel rock drill. Therefore, after the completion of the tunnel rock drilling operation, a manual acceptance method is usually used to detect the completion of tunnel excavation, which is not only complicated in acceptance steps but also consumes a lot of manpower. Relying on manual acceptance also has the defects such as a long feedback period and a high cost, which is not conducive to the efficient operation of the tunnel.

After the completion of the tunnel drilling operation, the health monitoring and analysis of the tunnel rock drill in the prior art often only focuses on the wear of the steel, ignoring the detailed monitoring of the internal parts of the machine, which is not conducive to timely understanding the internal damage of the tunnel rock drill, and further leads to the failure to scientifically and efficiently realize the stable development and reliable operation of the tunnel operation.

SUMMARY

In view of this, in order to solve the problems raised in the above background, a method for monitoring and analyzing large tunnel machines based on automatic collection of big data is proposed.

The purpose of the present disclosure can be achieved through the following technical scheme. The present disclosure provides a method for monitoring and analyzing large tunnel machines based on automatic collection of big data, including the following steps:

- Step 1, dividing a tunnel operation area: dividing the tunnel operation area into various tunnel operation sub-areas evenly according to an area;
- Step 2, obtaining environmental information of the tunnel operation sub-areas: monitoring environment of each tunnel operation sub-area to obtain the environmental information of each tunnel operation sub-area;
- Step 3, analyzing rock drilling difficulty of the tunnel operation sub-area: according to a model of a tunnel rock drill, extracting standard rock drilling intensity of the tunnel rock drill from a WEB cloud, and analyzing a rock drilling difficulty coefficient of each tunnel operation sub-area in combination with the environmental information of each tunnel operation sub-area;
- Step 4, confirming a tunnel operation trajectory: according to the rock drilling difficulty coefficient of each tunnel operation sub-area, analyzing a steel rotating speed corresponding to each tunnel operation sub-area, and then confirming the tunnel operation trajectory;
- Step 5, analyzing conformity of the tunnel operation sub-area: after the tunnel operation is completed, monitoring each tunnel operation sub-area and analyzing the operation conformity of each tunnel operation sub-area;
- Step 6, processing an abnormal tunnel operation sub-area: screening out each abnormal tunnel operation sub-area and processing each abnormal tunnel operation sub-area;
- Step 7, analyzing health state of a tunnel rock drill: after the processing of each abnormal tunnel operation sub-area is completed, monitoring the tunnel rock drill, calculating a health evaluation coefficient of the tunnel rock drill, and analyzing the health state of the tunnel rock drill.

Further, the environmental information includes soil moisture and geological information, where the geological information includes a volume and a hardness of each rock in the area.

Further, analyzing the rock drilling difficulty coefficient of each tunnel operation sub-area includes: according to the environmental information of each tunnel operation sub-area, extracting the volume and the hardness of each rock in each tunnel operation sub-area, which are denoted as $S_i^j$ and $p_i^j$, respectively, where i represents the number of each tunnel operation sub-area, i=1, 2, . . . , n, n represents the number of tunnel operation sub-areas, j represents the number of each rock in the area, j=1, 2, . . . , u, u represents the number of rocks in the area; screening out a maximum value of the rock hardness in each tunnel operation sub-area as a firmness of each tunnel operation sub-area, which is denoted as $\hat{p}_i$; extracting a total area and a tunnel operation depth of the tunnel operation area stored in the WEB cloud; dividing the total area of the tunnel operation area by the total number of the tunnel operation sub-areas to obtain the area $W_i$ of each tunnel operation sub-area; and obtaining a compressive strength of each tunnel operation sub-area by a formula $$\alpha_i = \ln\left(\frac{\sum_{j=1}^{u} s_i^j}{w_i * z} + \frac{\hat{p}_i - p_0}{p_0} + 2\right),$$

where $p_0$ represents a preset reference firmness of the tunnel operation sub-area, and z represents the tunnel operation depth;

extracting a standard rock drilling intensity F of the tunnel rock drill and a soil moisture $q_i$ of each tunnel operation sub-area, and analyzing the rock drilling difficulty coefficient of each tunnel operation sub-area, in which the calculation formula is:

$$\beta_i = \left(1 + 2^{\frac{q_0 - q_i}{q_0}}\right)^{\ln\left(1 + \frac{\alpha_i}{F}\right)},$$

where $q_0$ represents a preset reference soil moisture of the tunnel operation sub-area.

Further, the specific calculation formula of analyzing a steel rotating speed corresponding to each tunnel operation sub-area is as follows:

$$v_i = \begin{cases} (\beta_i - \lambda_1) * V_0' + V_{base}, \beta_i > \lambda_1 \\ (\beta_i - \lambda_2) * V_1' + V_{base}, \lambda_2 < \beta_i \le \lambda_1 \\ V_{base}, \beta_i \le \lambda_2 \end{cases};$$

where $\lambda_1$, $\lambda_2$ are tunnel drilling difficulty coefficients corresponding to a first echelon and a second echelon which are set, $v'_o$, $v'_1$ are reference steel rotating speeds of unit tunnel drilling difficulty coefficients corresponding to the first echelon and the second echelon, and $v_{base}$ is a set reference steel rotating speed of tunnel rock drilling, where $\lambda_1 > \lambda_2$.

Further, the specific process of confirming a tunnel operation trajectory is as follows: arranging the steel rotating speed of each tunnel operation sub-area in an ascending order, then performing secondary numbering on each tunnel operation sub-area according to this arrangement order, transmitting results of secondary numbering to a special computer of the rock drill, and then drawing the tunnel operation trajectory.

Further, analyzing conformity of the tunnel operation sub-area includes: carrying out real-scene scanning on each tunnel operation sub-area through a laser tunnel section detector installed on the tunnel rock drill; constructing a solid model of each tunnel operation sub-area; comparing the solid model of each tunnel operation sub-area with the corresponding area of a tunnel standard section model stored in an internal PAD of the laser tunnel section detector, the internal PAD being a disk used as a computer memory; screening out various normal, overbreak and underbreak tunnel operation sub-areas accordingly; obtaining an overbreak value of each overbreak tunnel operation sub-area and an underbreak value of each underbreak tunnel operation sub-area, respectively, which are denoted as $r_{i'}$, $g_{i'}$, $r_{i'}>0$, $g_{i''}<0$, where i' represents the number of each overbreak tunnel operation sub-area, i'=1', 2', . . . , n', where i" represents the number of each underbreak tunnel operation sub-area, i"=1", 2", . . . , n"; according to the formula $$\varphi_i' = \begin{cases} \frac{1}{2 + e^{\frac{r_i' - \Delta r}{\Delta r + 1}}}, r_i' > \Delta r \\ 1, 0 < r_i' \le \Delta r \end{cases},$$

obtaining the operation conformity of each overbreak tunnel operation sub-area, where Δr represents a preset tunnel allowable overbreak threshold, Δr>0, and e represents a natural constant;

obtaining the operation conformity of each underbreak tunnel operation sub-area according to the formula $$\varphi_i'' = \begin{cases} \frac{1}{1 + e^{\frac{|g_i'' - \Delta g|}{1 - \Delta g}}}, g_i'' < \Delta g \\ 1, \Delta g \le g_i'' < 0 \end{cases},$$

where Δg represents a preset tunnel allowable underbreak threshold, Δg<0;

denoting the operation conformity of each normal tunnel operation sub-area as 1;

regarding the operation conformity of various normal, overbreak and underbreak tunnel operation sub-areas as the operation conformity of each tunnel operation sub-area.

Further, the specific screening method of screening out each abnormal tunnel operation sub-area is as follows: comparing the operation conformity of each tunnel operation sub-area with the set operation conformity; if the operation conformity of a certain tunnel operation sub-area is less than the set operation conformity, denoting the tunnel operation sub-area as the tunnel abnormal operation sub-area; if the operation conformity of a certain tunnel operation sub-area is equal to the set operation conformity, denoting the tunnel operation sub-area as a tunnel qualified operation sub-area to obtain each abnormal tunnel operation sub-area.

Further, the processing process of processing each abnormal tunnel operation sub-area is as follows: extracting the completion of rock drilling in each abnormal tunnel operation sub-area; if the completion of rock drilling in a certain abnormal tunnel operation sub-area is overbreak, regarding the overbreak value of the abnormal operation sub-area as an earthwork backfilling depth, and carrying out earthwork backfilling processing on the abnormal operation sub-area; and if the completion of rock drilling in a certain abnormal tunnel operation sub-area is underbreak, regarding the number of the underbreak value of the abnormal operation sub-area as a secondary rocking drilling depth, and carrying out secondary rocking drilling processing on the abnormal operation sub-area.

Further, calculating a health evaluation coefficient of the tunnel rock drill includes: measuring a length of a front end of the steel of the tunnel rock drill using a length measuring tool to obtain a diameter d of the front end of the steel; and extracting a standard diameter d' of the front end of the steel from the WEB cloud according to the model of the steel;

placing the steel into a gear wear tester for testing, and performing detection to obtain a wear degree x of a middle end gear of the steel;

calculating a wear coefficient $\varepsilon_{steel}$ of the steel of the tunnel rock drill, in which the specific formula is:

$$\varepsilon_{steel} = \sqrt[3]{e^{\frac{d' - d - \Delta d}{\Delta d + 1} * a_1 + \frac{x - x'}{x' + 1} * a_2}},$$

where X' represents a preset reasonable wear threshold of the middle end gear of the steel, $a_1$, $a_2$ represents weight proportions of a preset wear coefficient corresponding to the front end wear and middle end wear of the steel, respectively, and $\Delta d$ represents a preset allowable wear difference of a diameter of the front end of the steel;

sampling oil products in an oil tank of a main hydraulic system of the tunnel rock drill according to a set sampling ratio to obtain each sample oil products; analyzing an iron spectrum and a copper spectrum of each sample oil product to obtain iron content and copper content of each sample oil product which are denoted as $Fe_m$, $Cu_m$, respectively, where m represents the number of each sample oil product, m=1, 2, . . . , t; and analyzing a pollution degree $\mu_m$ of each sample oil product, each sample oil in which the calculation formula is:

$$\mu_m = \left(\sqrt{e + 1}\right)^{\frac{Fe_m - Fe_{allowable}}{Fe_{allowable} + 1} * 1_1 + \frac{Cu_m - Cu_{allowable}}{Cu_{allowable} + 1} * 1_2},$$

where $Fe_{allowable}$, $Cu_{allowable}$ represent preset allowable iron content and copper content in the sample oil product, respectively, and $I_1$, $I_2$, represent preset weight proportions of pollution degrees corresponding to the iron content and the copper content of the sample oil product, respectively;

testing the bottom and the top of the oil tank of the main hydraulic system of the tunnel rock drill for pollutants, respectively, to obtain the pollution degrees of the bottom and the top of the oil tank, which are denoted as $WR_{bopttom}$, $WR_{top}$;

calculating a pollution coefficient $\sigma$ of the oil tank of the main hydraulic system of the tunnel rock drill, in which the specific formula is:

$$\sigma = \left\{\left[\frac{1}{t}\sum_{m=1}^{t}\mu_m + \frac{(\mu^{max} - \mu^{min})}{YX}\right] * \theta_1 + \left(\frac{3}{2}\right)^{\frac{WR_{bottom} - WR'_{bottom}}{WR'_{bottom} + 1} * \theta_2 + \frac{WR_{top} - WR'_{top}}{WR'_{top} + 1} * \theta_3}\right\}^{\frac{1}{2}},$$

where t represents a total number of sample oil products, $\mu^{max}$, $\mu^{min}$ represent a maximum value max min and a minimum value of the pollution degrees of the sample oil products, respectively, YX represents a preset allowable error, $WR'_{bottom}$, $WR'_{top}$ represent preset reasonable pollution degree thresholds of the bottom and the top of the oil tank, respectively, $\theta_1$, $\theta_2$, $\theta_3$ represent preset weight proportions of the pollution coefficients of the oil tank corresponding to the pollution degrees of the sample oil products, the top of the oil tank, and the bottom of the oil tank, respectively;

according to the pollution coefficient of the oil tank of the main hydraulic system of the tunnel rock drill, calculating the wear coefficient $\varepsilon_{internal}=\sigma*k$ of internal parts of the tunnel rock drill, where k represents a preset internal wear coefficient correction factor;

according to the wear coefficient of the steel and the internal parts of the tunnel rock drill, calculating a health evaluation coefficient $\xi$ of the tunnel rock drill, in which the specific formula is:

$$\xi = \left(\frac{1}{2}\right)^{\varepsilon_{steel} * y_1 + \varepsilon_{inter\ nal} * y_2},$$

where $y_1$, $y_2$ represent preset weight proportions of the health evaluation coefficients corresponding to the wear coefficients of the steel and the internal parts.

Further, the specific analysis method for analyzing health state of a tunnel rock drill includes: extracting the reasonable health evaluation coefficient threshold of the tunnel rock drill stored in the WEB cloud; comparing the health evaluation coefficient of the tunnel rock drill with the reasonable health evaluation coefficient threshold of the tunnel rock drill; if the health evaluation coefficient of the tunnel rock drill is less than the reasonable health evaluation coefficient threshold of the tunnel rock drill, determining that the tunnel rock drill is in the state of waiting for maintenance, sending a maintenance warning to the tunnel staff from the background, and otherwise determining that the tunnel rock drill is in the health state.

Compared with the prior art, the present disclosure has the following beneficial effects.

Firstly, by combining the basic parameters of the tunnel rock drill with the actual rock drilling environment, the present disclosure calculates the operation difficulty coefficient of each tunnel operation sub-area, which provides a scientific basis for the subsequent analysis of the rotating speed of the steel of the tunnel rock drill, and further lays a solid foundation for improving the tunnel operation efficiency.

Secondly, according to the operation difficulty coefficient of each tunnel operation sub-area, the present disclosure analyzes the rotating speed of the steel corresponding to each tunnel operation sub-area, and draws the tunnel operation trajectory accordingly, so that the steel of the tunnel rock drill is gradually increased from a low speed to a high speed, avoiding a series of problems that the rotating speed of the steel may fluctuate variously, which does not meet the geological conditions of the tunnel, thus leading to the damage of the steel, the increase of energy consumption of the rock drill, and the slowdown of the tunnel drilling speed. This improves the service life of the tunnel rock drill to a certain extent.

Thirdly, according to the present disclosure, after the tunnel operation is completed, the laser tunnel section detector installed on the tunnel rock drill monitors each tunnel operation sub-area to obtain the completion of rock drilling of each tunnel operation sub-area, and then the operation conformity of each tunnel operation sub-area is analyzed, and each abnormal tunnel operation sub-area is processed correspondingly in combination with the completion of rock drilling, thus effectively reducing the dependence on manual acceptance of the excavation surface, further overcoming the shortcoming of a long feedback period and a high cost. This is not only being beneficial to improving the operation integrity of the tunnel excavation surface, but also achieves efficient operation of the tunnel.

Fourthly, according to the present disclosure, the health state of the tunnel rock drill is monitored after completing the processing of each abnormal tunnel operation sub-area, and the health evaluation coefficient of the tunnel rock drill is analyzed from two aspects of wear of the steel and wear of the internal parts, so as to visually and digitally display the health state of the tunnel rock drill after operation, break the one-sidedness of the current health monitoring of the fixed tunnel rock drill, provide an auxiliary role for the development of fault maintenance work of the relevant staff, and further analyze and deal with mechanical faults in time, thus realizing the stable operation of tunnel operation scientifically and efficiently.

Lastly, according to the present disclosure, the wear condition of the internal parts of the tunnel rock drill is effectively obtained through the oil monitoring technology. That is, through the analysis of the worn metal particles and pollutants in the oil tank of the main hydraulic system of the tunnel rock drill, the diagnosis of the wear condition of the internal parts of the tunnel rock drill is realized, which provides a scientific basis for analyzing the health state of the tunnel rock drill, and further improves the use safety and reliability of the tunnel rock drill.

BRIEF DESCRIPTION OF THE DRAWINGS

In order to explain the technical scheme of the embodiment of the present disclosure more clearly, the drawings needed for the description of the embodiments will be briefly introduced hereinafter. Obviously, the drawings in the following description are only some embodiments of the present disclosure. For those skilled in the art, other drawings can be obtained according to these drawings without creative work.

FIG. 1 is a schematic flow chart of steps of a method according to the present disclosure.

DETAILED DESCRIPTION OF THE EMBODIMENTS

The technical scheme in the embodiment of the present disclosure will be clearly and completely described with reference to the attached drawings hereinafter. Obviously, the described embodiments are only some of the embodiments of the present disclosure, rather than all of the embodiments. Based on the embodiments in the present disclosure, all other embodiments obtained by those skilled in the art without creative work belong to the scope of protection of the present disclosure.

As shown in FIG. 1, the present disclosure provides a method for monitoring and analyzing large tunnel machines based on automatic collection of big data, including the following steps:

Step 1, a tunnel operation area is divided: dividing the tunnel operation area into various tunnel operation sub-areas evenly according to an area.

Step 2, environmental information of the tunnel operation sub-areas is obtained: monitoring environment of each tunnel operation sub-area to obtain the environmental information of each tunnel operation sub-area.

Illustratively, the environmental information includes soil moisture and geological information, where the geological information includes a volume and a hardness of each rock in the area.

It should be noted that the specific process of obtaining the environmental information of each tunnel operation sub-area is as follows: monitoring the soil moisture of each tunnel operation sub-area through a soil moisture monitor to obtain the soil moisture of each tunnel operation sub-area.

Acoustic waves are emitted to each tunnel operation sub-area through an acoustic wave detection device, and the acoustic signals are collected and drawn into acoustic waveforms. The shear wave velocity of the rock is obtained from the amplitude of the acoustic waveforms, and the compression wave velocity of the rock is obtained from the propagation velocity of the acoustic wave in the rock. The rock type is obtained from the shear wave velocity and the compression wave velocity of the rock. According to the rock type, the density and Poisson's ratio of the rock are extracted from the established database, which are denoted as $\rho$, $\overline{\omega}$, respectively. The elastic modulus of the rock is obtained from the formula $$E=\rho*Vp*2*(1-2\overline{\omega})$$

where Vp represents a compression wave velocity of the rock. According to the elastic modulus of the rock, the hardness of the rock corresponding to the elastic modulus of the rock is extracted from the established database, and the hardness of each rock in each tunnel operation sub-area is obtained.

The compression wave velocity and the shear wave velocity of the rock are input into an acoustic measurement system. The model of the rock is constructed through the nondestructive testing of the rock in the acoustic measurement system. The volume of the rock is obtained by CAD, and then the volume of each rock in each tunnel operation sub-area is obtained.

The soil moisture, the volume and the hardness of each rock in each tunnel operation sub-area are regarded as the environmental information of each tunnel operation sub-area.

Step 3, rock drilling difficulty of the tunnel operation sub-area is analyzed: according to a model of a tunnel rock drill, extracting standard rock drilling intensity of the tunnel rock drill from a WEB cloud, and analyzing a rock drilling difficulty coefficient of each tunnel operation sub-area in combination with the environmental information of each tunnel operation sub-area.

Illustratively, analyzing the rock drilling difficulty coefficient of each tunnel operation sub-area includes: according to the environmental information of each tunnel operation sub-area, extracting the volume and the hardness of each rock in each tunnel operation sub-area, which are denoted as $S_i^j$ and $p_i^j$, respectively, where i represents the number of each tunnel operation sub-area, i=1, 2, . . . , n, n represents the number of tunnel operation sub-areas, j represents the number of each rock in the area, j=1, 2, . . . , u, u represents the number of rocks in the area; screening out a maximum value of the rock hardness in each tunnel operation sub-area as a firmness of each tunnel operation sub-area, which is denoted as $\hat{p}_i$; extracting a total area and a tunnel operation depth of the tunnel operation area stored in the WEB cloud; dividing the total area of the tunnel operation area by the total number of the tunnel operation sub-areas to obtain the area $W_i$ of each tunnel operation sub-area; and obtaining a compressive strength of each tunnel operation sub-area by a formula $$\alpha_i = \ln\left(\frac{\sum_{j=1}^{u} s_i^j}{w_i * z} + \frac{\hat{p}_i - p_0}{p_0} + 2\right),$$

where $P_0$ represents a preset reference firmness of the tunnel operation sub-area, and z represents the tunnel operation depth.

It should be noted that the hardness of each rock in each tunnel sub-area is greater than 0.

A standard rock drilling intensity F of the tunnel rock drill and a soil moisture $q_i$ of each tunnel operation sub-area are extracted, and the rock drilling difficulty coefficient of each tunnel operation sub-area is analyzed, in which the calculation formula is:

$$\beta_i = \left(1 + 2^{\frac{q_0 - q_i}{q_0}}\right)^{\ln\left(1+\frac{\alpha_i}{F}\right)},$$

where $q_0$ represents a preset reference soil moisture of the tunnel operation sub-area.

In the specific embodiments of the present disclosure, by combining the basic parameters of the tunnel rock drill with the actual rock drilling environment, the present disclosure calculates the operation difficulty coefficient of each tunnel operation sub-area, which provides a scientific basis for the subsequent analysis of the rotating speed of the steel of the tunnel rock drill, and further lays a solid foundation for improving the tunnel operation efficiency.

Step 4, a tunnel operation trajectory is confirmed: according to the rock drilling difficulty coefficient of each tunnel operation sub-area, analyzing a steel rotating speed corresponding to each tunnel operation sub-area, and then confirming the tunnel operation trajectory.

Illustratively, the specific calculation formula of analyzing a steel rotating speed corresponding to each tunnel operation sub-area is as follows:

$$v_i = \begin{cases} (\beta_i - \lambda_1) * v_0' + v_{base}, \beta_i > \lambda_1 \\ (\beta_i - \lambda_2) * v_1' + V_{base}, \lambda_2 < \beta_i \le \lambda_1 \\ v_{base}, \beta_i \le \lambda_2 \end{cases};$$

where $\lambda_1$, $\lambda_2$ are tunnel drilling difficulty coefficients corresponding to a first echelon and a second echelon which are set, $v'_0$, $v'_1$ are reference steel rotating speeds of unit tunnel drilling difficulty coefficients corresponding to the first echelon and the second echelon, and $v_{base}$ is a set reference steel rotating speed of tunnel rock drilling, where $\lambda_1 > \lambda_2$.

Illustratively, the specific process of confirming a tunnel operation trajectory is as follows: arranging the steel rotating speed of each tunnel operation sub-area in an ascending order, then performing secondary numbering on each tunnel operation sub-area according to this arrangement order, transmitting results of secondary numbering to a special computer of the rock drill, and then drawing the tunnel operation trajectory.

In the specific embodiments of the present disclosure, according to the operation difficulty coefficient of each tunnel operation sub-area, the present disclosure analyzes the rotating speed of the steel corresponding to each tunnel operation sub-area, and draws the tunnel operation trajectory accordingly, so that the steel of the tunnel rock drill is gradually increased from a low speed to a high speed, avoiding a series of problems that the rotating speed of the steel may fluctuate variously, which does not meet the geological conditions of the tunnel, thus leading to the damage of the steel, the increase of energy consumption of the rock drill, and the slowdown of the tunnel drilling speed. This improves the service life of the tunnel rock drill to a certain extent.

Step 5, conformity of the tunnel operation sub-area is analyzed: after the tunnel operation is completed, monitoring each tunnel operation sub-area and analyzing the operation conformity of each tunnel operation sub-area.

Illustratively, analyzing conformity of the tunnel operation sub-area includes: carrying out real-scene scanning on each tunnel operation sub-area through a laser tunnel section detector installed on the tunnel rock drill; constructing a solid model of each tunnel operation sub-area; comparing the solid model of each tunnel operation sub-area with the corresponding area of a tunnel standard section model stored in an internal PAD of the laser tunnel section detector; screening out various normal, overbreak and underbreak tunnel operation sub-areas accordingly; obtaining an overbreak value of each overbreak tunnel operation sub-area and an underbreak value of each underbreak tunnel operation sub-area, respectively, which are denoted as $r_{i'}$, $g_{i''}$, $r_{i'}>0$, $g_{i''}<0$, where i' represents the number of each overbreak tunnel operation sub-area, i'=1', 2', . . . , n' where i" represents the number of each underbreak tunnel operation sub-area, i"=1", 2", . . . , n"; according to the formula $$\varphi_i' = \begin{cases} \frac{1}{2 + e^{\frac{|r_i' - \Delta r|}{\Delta r + 1}}}, r_i' > \Delta r \\ 1, 0 < r_i' \le \Delta r \end{cases},$$

obtaining the operation conformity of each overbreak tunnel operation sub-area, where Δr represents a preset tunnel allowable overbreak threshold, Δr>0, and e represents a natural constant.

It should be noted that the specific screening process of screening out various normal, overbreak and underbreak tunnel operation sub-areas as follows: comparing the solid model of each tunnel operation sub-area with the corresponding area of the tunnel standard section model, denoting the obtained graph as the comparison graph of each tunnel operation sub-area, comparing the comparison graph of each tunnel operation sub-area with the preset standard comparison graph of the normal, overbreak and underbreak tunnel operation sub-areas, respectively, and screening out the normal, overbreak and underbreak tunnel operation sub-areas.

The operation conformity of each underbreak tunnel operation sub-area is obtained according to the formula $$\varphi_i'' = \begin{cases} \frac{1}{1 + e^{\frac{|g_i'' - \Delta g|}{1 - \Delta g}}}, g_i'' < \Delta g \\ 1, \Delta g \le g_i'' < 0 \end{cases},$$

where Δg represents a preset tunnel allowable underbreak threshold, Δg<0.

The operation conformity of each normal tunnel operation sub-area is denoted as 1.

The operation conformity of various normal, overbreak and underbreak tunnel operation sub-areas is regarded as the operation conformity of each tunnel operation sub-area.

It should be noted that, as described above, n'+n"≤n, where n represents the total number of the tunnel operation sub-areas, and n', n" represent the total number of overbreak and underbreak tunnel operation sub-areas, respectively.

Step 6, an abnormal tunnel operation sub-area is processed: screening out each abnormal tunnel operation sub-area and processing each abnormal tunnel operation sub-area.

Illustratively, the specific screening method of screening out each abnormal tunnel operation sub-area is as follows: comparing the operation conformity of each tunnel operation sub-area with the set operation conformity; if the operation conformity of a certain tunnel operation sub-area is less than the set operation conformity, denoting the tunnel operation sub-area as the tunnel abnormal operation sub-area; if the operation conformity of a certain tunnel operation sub-area is equal to the set operation conformity, denoting the tunnel operation sub-area as a tunnel qualified operation sub-area to obtain each abnormal tunnel operation sub-area.

It should be noted that the operation conformity set above is 1.

Illustratively, the processing process of processing each abnormal tunnel operation sub-area is as follows: extracting the completion of rock drilling in each abnormal tunnel operation sub-area; if the completion of rock drilling in a certain abnormal tunnel operation sub-area is overbreak, regarding the overbreak value of the abnormal operation sub-area as an earthwork backfilling depth, and carrying out earthwork backfilling processing on the abnormal operation sub-area; and if the completion of rock drilling in a certain abnormal tunnel operation sub-area is underbreak, regarding the number of the underbreak value of the abnormal operation sub-area as a secondary rocking drilling depth, and carrying out secondary rocking drilling processing on the abnormal operation sub-area.

In the specific embodiments of the present disclosure, after the tunnel operation is completed, the laser tunnel section detector installed on the tunnel rock drill monitors each tunnel operation sub-area to obtain the completion of rock drilling of each tunnel operation sub-area, and then the operation conformity of each tunnel operation sub-area is analyzed, and each abnormal tunnel operation sub-area is processed correspondingly in combination with the completion of rock drilling, thus effectively reducing the dependence on manual acceptance of the excavation surface, further overcoming the shortcoming of a long feedback period and a high cost. This is not only being beneficial to improving the operation integrity of the tunnel excavation surface, but also achieves efficient operation of the tunnel.

Step 7, health state of a tunnel rock drill is analyzed: after the processing of each abnormal tunnel operation sub-area is completed, monitoring the tunnel rock drill, calculating a health evaluation coefficient of the tunnel rock drill, and analyzing the health state of the tunnel rock drill.

Illustratively, calculating a health evaluation coefficient of the tunnel rock drill includes: measuring a length of a front end of the steel of the tunnel rock drill using a length measuring tool to obtain a diameter d of the front end of the steel; and extracting a standard diameter d' of the front end of the steel from the WEB cloud according to the model of the steel.

The steel is placed into a gear wear tester for testing, and detection is performed to obtain a wear degree x of a middle end gear of the steel.

It should be noted that the specific process of obtaining the wear degree of the middle end gear of the steel is as follows: the geometric dimension h and the precision c of the middle end gear of the steel are obtained by detection through the testing system in the gear wear tester. The standard geometric dimension ho and the standard precision c, of the middle end gear of the steel are extracted from the established database according to the model of the steel. The wear degree of the middle end gear of the steel is obtained according to the formula $$x = e^{-\left(\frac{h}{h_0}*\kappa_1+\frac{c}{c_0}*\kappa_2\right)},$$

in which $\kappa_1$, $\kappa_2$ represent preset weight proportions of the wear degrees corresponding to the geometric dimension and the precision of the middle end gear of the steel, respectively.

A wear coefficient $\varepsilon_{steel}$ of the steel of the tunnel rock drill is calculated, in which the specific formula is:

$$\varepsilon_{steel} = \sqrt[3]{e^{\frac{d'-d-\Delta d}{\Delta d+1}*a_1+\frac{x-x'}{x'+1}*a_2}},$$

where X' represents a preset reasonable wear threshold of the middle end gear of the steel, $a_1$, $a_2$ represents weight proportions of a preset wear coefficient corresponding to the front end wear and middle end wear of the steel, respectively, and $\Delta d$ represents a preset allowable wear difference of a diameter of the front end of the steel.

Oil products in an oil tank of a main hydraulic system of the tunnel rock drill are sampled according to a set sampling ratio to obtain each sample oil products; an iron spectrum and a copper spectrum of each sample oil product are analyzed to obtain iron content and copper content of each sample oil product which are denoted as $Fe_m$, $Cu_m$, respectively, where m represents the number of each sample oil product, m=1, 2, . . . , t; and a pollution degree $\mu_m$ of each sample oil product is analyzed, in which the calculation formula is:

$$\mu_m = \left(\sqrt{e+1}\right)^{\frac{Fe_m-Fe_{allowable}}{Fe_{allowable}+1}*1_1+\frac{Cu_mCu_{allowable}}{Cu_{allowable}+1}*1_2},$$

where $Fe_{allowable}$, $Cu_{allowable}$ represent preset allowable iron content and copper content in the sample oil product, respectively, and $I_1$, $I_2$ represent preset weight proportions of pollution degrees corresponding to the iron content and the copper content of the sample oil product, respectively.

The bottom and the top of the oil tank of the main hydraulic system of the tunnel rock drill are tested for pollutants, respectively, to obtain the pollution degrees of the bottom and the top of the oil tank, which are denoted as $WR_{bopttom}$, $WR_{top}$.

It should be noted that the specific process of obtaining the pollution degrees of the bottom and the top of the oil tank is as follows: draining the oil in the oil tank of the main hydraulic system of the tunnel rock drill, and detecting the total thickness and the total paved area of pollutants at the bottom of the oil tank by using a detector and a water depth meter, which are denoted as b, f, respectively. The pollution degree of the bottom of the oil tank is obtained according to the formula $$WR_{bottom} = \sqrt{\frac{b}{\eta}*\delta_1+\frac{f}{\gamma_{bottom}}*\delta_2+1},$$

wherein $\delta_1$, $\delta_2$ represent preset weight proportions of the pollution degrees corresponding to the total thickness and the total paved area of pollutants, respectively, and $\eta$, $\gamma_{bottom}$ represent the preset areas of the height of the oil tank and the bottom of the oil tank, respectively.

The pollution degree of the top of the oil tank is obtained in accordance with the above calculation method of the pollution degree of the bottom of the oil tank.

A pollution coefficient $\sigma$ of the oil tank of the main hydraulic system of the tunnel rock drill is calculated, in which the specific formula is:

$$\sigma = \left\{\left[\frac{1}{t}\sum_{m=1}^{t}\mu_m + \frac{(\mu^{max} - \mu^{min})}{YX}\right] * \theta_1 + \left(\frac{3}{2}\right)^{\frac{WR_{bottom} - WR'_{bottom}}{WR'_{bottom}+1} * \theta_2 + \frac{WR_{top} - WR'_{top}}{WR'_{top}+1} * \theta_3}\right\}^{\frac{1}{2}},$$

where t represents a total number of sample oil products, $\mu^{max}$, $\mu^{min}$ represent a maximum value and a minimum value of the pollution degrees of the sample oil products, respectively, YX represents a preset allowable error, $WR'_{bottom}$, $WR'_{top}$ represent preset reasonable pollution degree thresholds of the bottom and the top of the oil tank, respectively, $\theta_1$, $\theta_2$, $\theta_3$ represent preset weight proportions of the pollution coefficients of the oil tank corresponding to the pollution degrees of the sample oil products, the top of the oil tank, and the bottom of the oil tank, respectively.

According to the pollution coefficient of the oil tank of the main hydraulic system of the tunnel rock drill, calculating the wear coefficient $\varepsilon_{internal}=\sigma*k$ of internal parts of the tunnel rock drill, where k represents a preset internal wear coefficient correction factor.

According to the present disclosure, the wear condition of the internal parts of the tunnel rock drill is effectively obtained through the oil monitoring technology. That is, through the analysis of the worn metal particles and pollutants in the oil tank of the main hydraulic system of the tunnel rock drill, the diagnosis of the wear condition of the internal parts of the tunnel rock drill is realized, which provides a scientific basis for analyzing the health state of the tunnel rock drill, and further improves the use safety and reliability of the tunnel rock drill.

According to the wear coefficient of the steel and the internal parts of the tunnel rock drill, calculating a health evaluation coefficient § of the tunnel rock drill, and the specific formula is:

$$\xi = \left(\frac{1}{2}\right)^{\varepsilon_{steel}*y_1 + \varepsilon_{inter\ nal}*y_2},$$

where $y_1$, $y_2$ represent preset weight proportions of the health evaluation coefficients corresponding to the wear coefficients of the steel and the internal parts.

Illustratively, the specific analysis method for analyzing health state of a tunnel rock drill includes: extracting the reasonable health evaluation coefficient threshold of the tunnel rock drill stored in the WEB cloud; comparing the health evaluation coefficient of the tunnel rock drill with the reasonable health evaluation coefficient threshold of the tunnel rock drill; if the health evaluation coefficient of the tunnel rock drill is less than the reasonable health evaluation coefficient threshold of the tunnel rock drill, determining that the tunnel rock drill is in the state of waiting for maintenance, sending a maintenance warning to the tunnel staff from the background, and otherwise determining that the tunnel rock drill is in the health state.

In the specific embodiments of the present disclosure, the health state of the tunnel rock drill is monitored after completing the processing of each abnormal tunnel operation sub-area, and the health evaluation coefficient of the tunnel rock drill is analyzed from two aspects of wear of the steel and wear of the internal parts, so as to visually and digitally display the health state of the tunnel rock drill after operation, break the one-sidedness of the current health monitoring of the fixed tunnel rock drill, provide an auxiliary role for the development of fault maintenance work of the relevant staff, and further analyze and deal with mechanical faults in time, thus realizing the stable operation of tunnel operation scientifically and efficiently.

The above is only the illustration and explanation of the concept of the present disclosure. Various modifications or additions to the described specific embodiments or substitutions in a similar manner made by those skilled in the art shall fall within the scope of protection of the present disclosure as long as they do not deviate from the concept of the present disclosure or exceed the scope of the present disclosure as defined herein.

What is claimed is:

1. A method for monitoring and analyzing large tunnel machines based on automatic collection of big data, comprising the following steps:

Step 1, dividing a tunnel operation area: dividing the tunnel operation area into various tunnel operation sub-areas evenly according to an area;

Step 2, obtaining environmental information of the tunnel operation sub-areas: monitoring environment of each tunnel operation sub-area to obtain the environmental information of each tunnel operation sub-area;

Step 3, analyzing rock drilling difficulty of each tunnel operation sub-area: according to a model of a tunnel rock drill, extracting standard rock drilling intensity of the tunnel rock drill from a WEB cloud, and analyzing a rock drilling difficulty coefficient of each tunnel operation sub-area in combination with the environmental information of each tunnel operation sub-area;

Step 4, confirming a tunnel operation trajectory: according to the rock drilling difficulty coefficient of each tunnel operation sub-area, analyzing a steel rotating speed corresponding to each tunnel operation sub-area, and then confirming the tunnel operation trajectory;

Step 5, analyzing conformity of each tunnel operation sub-area: after tunnel operation is completed, monitoring each tunnel operation sub-area and analyzing the operation conformity of each tunnel operation sub-area;

Step 6, processing an abnormal tunnel operation sub-area: screening out each abnormal tunnel operation sub-area and processing each abnormal tunnel operation sub-area; and Step 7, analyzing health state of a tunnel rock drill: after the processing of each abnormal tunnel operation sub-area is completed, monitoring the tunnel rock drill, calculating a health evaluation coefficient of the tunnel rock drill, and analyzing the health state of the tunnel rock drill.

2. The method for monitoring and analyzing large tunnel machines based on automatic collection of big data according to claim 1, wherein the environmental information comprises soil moisture and geological information, the geological information comprises a volume and a hardness of each rock in each tunnel operation sub-area.

3. The method for monitoring and analyzing large tunnel machines based on automatic collection of big data according to claim 2, wherein analyzing the rock drilling difficulty coefficient of each tunnel operation sub-area comprises: according to the environmental information of each tunnel operation sub-area, extracting the volume and the hardness of each rock in each tunnel operation sub-area, which are denoted as $S_i^j$ and $p_i^j$, respectively, wherein i represents the number of each tunnel operation sub-area, i=1, 2, . . . , n, n represents the number of tunnel operation sub-areas, j represents the number of each rock in the area, j=1, 2, . . . , u, u represents the number of rocks in the area; screening out a maximum value of the rock hardness in each tunnel operation sub-area as a firmness of each tunnel operation sub-area, which is denoted as $\hat{p}_i$; extracting a total area and a tunnel operation depth of the tunnel operation area stored in the WEB cloud; dividing the total area of the tunnel operation area by the total number of the tunnel operation sub-areas to obtain the area $w_i$ of each tunnel operation sub-area; and obtaining a compressive strength of each tunnel operation sub-area by a formula $$\alpha_i = \ln\left(\frac{\sum_{j=1}^{u} s_i^j}{w_i * z} + \frac{\hat{p}_i - p_0}{p_0} + 2\right),$$

wherein $p_0$ represents a preset reference firmness of the tunnel operation sub-area, and z represents the tunnel operation depth;

extracting a standard rock drilling intensity F of the tunnel rock drill and a soil moisture $q_i$ of each tunnel operation sub-area, and analyzing the rock drilling difficulty coefficient of each tunnel operation sub-area, in which the calculation formula is:

$$\beta_i = \left(1 + 2^{\frac{q_0 - q_i}{q_0}}\right)^{\ln\left(1 + \frac{\alpha_i}{F}\right)},$$

wherein $q_0$ represents a preset reference soil moisture of the tunnel operation sub-area.

4. The method for monitoring and analyzing large tunnel machines based on automatic collection of big data according to claim 3, wherein the specific calculation formula of analyzing a steel rotating speed corresponding to each tunnel operation sub-area is as follows:

$$v_i = \begin{cases} (\beta_i - \lambda_1) * v'_0 + v_{base}, & \beta_i > \lambda_1 \\ (\beta_i - \lambda_2) * v'_1 + v_{base}, & \lambda_2 < \beta_i \le \lambda_1 \\ v_{base}, & \beta_i \le \lambda_2 \end{cases};$$

wherein $\lambda_1$, $\lambda_2$ are tunnel drilling difficulty coefficients corresponding to a first echelon and a second echelon which are set, $v'_0$, $v'_1$ are reference steel rotating speeds of unit tunnel drilling difficulty coefficients corresponding to the first echelon and the second echelon, and $v_{base}$ is a set reference steel rotating speed of tunnel rock drilling, $\lambda_1 > \lambda_2$.

5. The method for monitoring and analyzing large tunnel machines based on automatic collection of big data according to claim 4, wherein the specific process of confirming a tunnel operation trajectory is as follows: arranging the steel rotating speed of each tunnel operation sub-area in an ascending order, then performing secondary numbering on each tunnel operation sub-area according to this arrangement order, transmitting results of secondary numbering to a special computer of the rock drill, and then drawing the tunnel operation trajectory.

6. The method for monitoring and analyzing large tunnel machines based on automatic collection of big data according to claim 1, wherein analyzing conformity of the tunnel operation sub-area comprises: carrying out real-scene scanning on each tunnel operation sub-area through a laser tunnel section detector installed on the tunnel rock drill; constructing a solid model of each tunnel operation sub-area; comparing the solid model of each tunnel operation sub-area with the corresponding area of a tunnel standard section model stored in an internal PAD of the laser tunnel section detector; screening out various normal, overbreak and underbreak tunnel operation sub-areas accordingly; obtaining an overbreak value of each overbreak tunnel operation sub-area and an underbreak value of each underbreak tunnel operation sub-area, respectively, which are denoted as $r_{i'}$, $g_{i''}>0$, $g_{i''}<0$, wherein j' represents the number of each overbreak tunnel operation sub-area, i'=1', 2', . . . , n', wherein i" represents the number of each underbreak tunnel operation sub-area, i"=1", 2", . . . , n"; according to the formula $$\varphi'_i = \begin{cases} \frac{1}{2 + e^{\frac{r'_i - \Delta r}{\Delta r + 1}}}, & r'_i > \Delta r \\ 1, & 0 < r'_i \le \Delta r \end{cases},$$

obtaining the operation conformity of each overbreak tunnel operation sub-area, wherein Δr represents a preset tunnel allowable overbreak threshold, Δr>0, and e represents a natural constant;

obtaining the operation conformity of each underbreak tunnel operation sub-area according to the formula $$\varphi''_i = \begin{cases} \frac{1}{1 + e^{\frac{|g''_i - \Delta g|}{1 - \Delta g}}}, & g''_i < \Delta g \\ 1, & \Delta g \le g''_i < 0 \end{cases},$$

wherein Δg represents a preset tunnel allowable underbreak threshold, Δg<0;

denoting the operation conformity of each normal tunnel operation sub-area as 1;

regarding the operation conformity of various normal, overbreak and underbreak tunnel operation sub-areas as the operation conformity of each tunnel operation sub-area.

7. The method for monitoring and analyzing large tunnel machines based on automatic collection of big data according to claim 6, wherein the specific screening method of screening out each abnormal tunnel operation sub-area is as follows: comparing the operation conformity of each tunnel operation sub-area with the set operation conformity; if the operation conformity of a certain tunnel operation sub-area is less than the set operation conformity, denoting the tunnel operation sub-area as the tunnel abnormal operation sub-area; if the operation conformity of a certain tunnel operation sub-area is equal to the set operation conformity, denoting the tunnel operation sub-area as a tunnel qualified operation sub-area to obtain each abnormal tunnel operation sub-area.

8. The method for monitoring and analyzing large tunnel machines based on automatic collection of big data according to claim 7, wherein a process of processing each abnormal tunnel operation sub-area is as follows: extracting the completion of rock drilling in each abnormal tunnel operation sub-area; if the completion of rock drilling in a certain abnormal tunnel operation sub-area is overbreak, regarding the overbreak value of the abnormal operation sub-area as an earthwork backfilling depth, and carrying out earthwork backfilling processing on the abnormal operation sub-area; and if the completion of rock drilling in a certain abnormal tunnel operation sub-area is underbreak, regarding the number of the underbreak value of the abnormal operation sub-area as a secondary rocking drilling depth, and carrying out secondary rocking drilling processing on the abnormal operation sub-area.

9. The method for monitoring and analyzing large tunnel machines based on automatic collection of big data according to claim 1, wherein calculating a health evaluation coefficient of the tunnel rock drill comprises: measuring a length of a front end of the steel of the tunnel rock drill using a length measuring tool to obtain a diameter d of the front end of the steel; and extracting a standard diameter d' of the front end of the steel from the WEB cloud according to the model of the steel;

placing the steel into a gear wear tester for testing, and performing detection to obtain a wear degree x of a middle end gear of the steel;

calculating a wear coefficient $\varepsilon_{steel}$ of the steel of the tunnel rock drill, in which the specific formula is:

$$e_{steel} = \sqrt[3]{e^{\frac{d' - d - \Delta d}{\Delta d + 1} * a_1 + \frac{x - x'}{x' + 1} * a_2}},$$

wherein X' represents a preset reasonable wear threshold of the middle end gear of the steel, $a_1$, $a_2$ represents weight proportions of a preset wear coefficient corresponding to the front end wear and middle end wear of the steel, respectively, and Δd represents a preset allowable wear difference of a diameter of the front end of the steel;

sampling oil products in an oil tank of a main hydraulic system of the tunnel rock drill according to a set sampling ratio to obtain each sample oil products; analyzing an iron spectrum and a copper spectrum of each sample oil product to obtain iron content and copper content of each sample oil product which are denoted as $Fe_m$, $Cu_m$, respectively, wherein m represents the number of each sample oil product, m=1, 2, . . . , t; and analyzing a pollution degree $\mu_m$ of each sample oil product, in which the calculation formula is:

$$\mu_m = \left(\sqrt{e + 1}\right)^{\frac{Fe_m - Fe_{allowable}}{Fe_{allowable} + 1} * 1_1 + \frac{Cu_m - Cu_{allowable}}{Cu_{allowable} + 1} * 1_2},$$

wherein $Fe_{allowable}$, $Cu_{allowable}$ represent preset allowable iron content and copper content in the sample oil product, respectively, and $I_1$, $I_2$ represent preset weight proportions of pollution degrees corresponding to the iron content and the copper content of the sample oil product, respectively;

testing the bottom and the top of the oil tank of the main hydraulic system of the tunnel rock drill for pollutants, respectively, to obtain the pollution degrees of the bottom and the top of the oil tank, which are denoted as $WR_{bopttom}$, $WR_{top}$;

calculating a pollution coefficient σ of the oil tank of the main hydraulic system of the tunnel rock drill, in which the specific formula is:

$$\sigma = \left\{\left[\frac{1}{t}\sum_{m=1}^{t}\mu_m + \frac{(\mu^{max} - \mu^{min})}{YX}\right] * \theta_1 + \left(\frac{3}{2}\right)^{\frac{WR_{bottom} - WR'_{bottom}}{WR'_{bottom} + 1} * \theta_2 + \frac{WR_{top} - WR'_{top}}{WR'_{top} + 1} * \theta_3}\right\}^{\frac{1}{2}},$$

wherein t represents a total number of sample oil products, $\mu^{max}$, $\mu^{min}$ represent a maximum value and a minimum value of the pollution degrees of the sample oil products, respectively, YX represents a preset allowable error, $WR'_{bottom}$, $WR'_{top}$ top represent preset reasonable pollution degree thresholds of the bottom and the top of the oil tank, respectively, $\theta_1$, $\theta_2$, $\theta_3$ represent preset weight proportions of the pollution coefficients of the oil tank corresponding to the pollution degrees of the sample oil products, the top of the oil tank, and the bottom of the oil tank, respectively;

according to the pollution coefficient of the oil tank of the main hydraulic system of the tunnel rock drill, calculating the wear coefficient $\varepsilon_{internal}\sigma * k$ of internal parts of the tunnel rock drill, wherein k represents a preset internal wear coefficient correction factor;

according to the wear coefficient of the steel and the internal parts of the tunnel rock drill, calculating a health evaluation coefficient ξ of the tunnel rock drill, in which the specific formula is:

$$\xi = \left(\frac{1}{2}\right)^{\varepsilon_{steel} * y_1 + \varepsilon_{internal} * y_2},$$

wherein $y_1$, $y_2$ represent preset weight proportions of the health evaluation coefficients corresponding to the wear coefficients of the steel and the internal parts.

10. The method for monitoring and analyzing large tunnel machines based on automatic collection of big data according to claim 9, wherein the specific analysis method for analyzing health state of a tunnel rock drill comprises: extracting the reasonable health evaluation coefficient threshold of the tunnel rock drill stored in the WEB cloud; comparing the health evaluation coefficient of the tunnel rock drill with the reasonable health evaluation coefficient threshold of the tunnel rock drill; if the health evaluation coefficient of the tunnel rock drill is less than the reasonable health evaluation coefficient threshold of the tunnel rock drill, determining that the tunnel rock drill is in the state of waiting for maintenance, sending a maintenance warning to the tunnel staff from the background, and otherwise determining that the tunnel rock drill is in the health state.

* * * * *